US007628033B1

(12) United States Patent
Skeels et al.

(10) Patent No.: US 7,628,033 B1
(45) Date of Patent: Dec. 8, 2009

(54) REMOVABLE COOLER ACCESSORY TO PREVENT SOAKING

(76) Inventors: David W. Skeels, 4000 Blue Ox Dr. Southeast, Space 5, Albany, OR (US) 97321; Kirt D. Curran, 33175 McFarland Rd., Unit 39, Tangent, OR (US) 97389

( * ) Notice: Subject to any disclaimer, the term of this patent is extended or adjusted under 35 U.S.C. 154(b) by 645 days.

(21) Appl. No.: 11/094,636

(22) Filed: Mar. 31, 2005

(51) Int. Cl.
*F25D 3/00* (2006.01)

(52) U.S. Cl. ..... 62/459; 62/371; 62/457.1

(58) Field of Classification Search ..... 62/60, 62/371, 457.1, 457.9, 459, 460, 465; 220/410, 220/560.14, 572, 592.02, 592.05; *F25D 3/08*
See application file for complete search history.

(56) References Cited

U.S. PATENT DOCUMENTS

| | | | | | |
|---|---|---|---|---|---|
| 51,035 | A | * | 11/1865 | Forbes et al. | 62/464 |
| 343,873 | A | * | 6/1886 | Walker | 62/265 |
| 1,882,011 | A | * | 10/1932 | Heygel | 62/298 |
| 2,062,140 | A | * | 11/1936 | Merrill | 62/89 |
| 2,114,086 | A | * | 4/1938 | Reilly | 62/298 |
| 2,117,564 | A | * | 5/1938 | Merrill | 62/413 |
| 2,129,255 | A | * | 9/1938 | Andros | 62/424 |
| 2,169,712 | A | * | 8/1939 | Sisson | 105/375 |
| 2,187,219 | A | * | 1/1940 | Bonsall | 105/375 |
| 2,237,405 | A | * | 4/1941 | Bonsall | 62/423 |
| 2,252,225 | A | * | 8/1941 | Bonsall | 62/245 |
| 4,424,687 | A | * | 1/1984 | Morgan | 62/457.1 |
| 4,565,074 | A | * | 1/1986 | Morgan | 62/457.1 |
| 5,052,185 | A | * | 10/1991 | Spahr | 62/60 |
| 5,493,874 | A | * | 2/1996 | Landgrebe | 62/457.2 |
| 5,605,056 | A | * | 2/1997 | Brown et al. | 62/457.4 |
| 5,845,515 | A | | 12/1998 | Nelson | |
| D403,925 | S | | 1/1999 | Moffett, III et al. | |
| 5,931,019 | A | * | 8/1999 | White et al. | 62/457.7 |
| 6,126,124 | A | | 10/2000 | Wagner | |
| 6,145,261 | A | * | 11/2000 | Godfrey et al. | 52/302.1 |
| D448,249 | S | | 9/2001 | DeCastro et al. | |
| 6,349,559 | B1 | | 2/2002 | Hasanovic | |
| 6,405,557 | B1 | * | 6/2002 | DeCastro et al. | 62/459 |
| 6,536,228 | B1 | | 3/2003 | Hall | |
| 6,626,006 | B1 | | 9/2003 | Tedder | |
| 2003/0121277 | A1 | * | 7/2003 | Simmons | 62/457.2 |

FOREIGN PATENT DOCUMENTS

| | | | |
|---|---|---|---|
| GB | 2113074 A | * | 8/1983 |
| JP | 07207890 | * | 8/1995 |

* cited by examiner

*Primary Examiner*—Melvin Jones

(57) ABSTRACT

A portable accessory includes a plurality of platforms having substantially planar upper surfaces for supporting the foodstuff thereon. Each platform is provided with baffled slots such that melted ice can drain downwardly therethrough. In an alternate embodiment, a plurality of spaced racks are slidably positionable within a cooler body such that the racks become spaced apart adjacent to opposed ends of a cooler body. Such racks are offset at an oblique angle so that melted ice is directed downwardly and away from the top surfaces of the platforms. In a further embodiment, a specially designed cooler is provided with slots for receiving the racks therein such that the platforms can be simultaneously employed with the racks.

15 Claims, 6 Drawing Sheets

REMOVABLE COOLER ACCESSORY TO PREVENT SOAKING

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cooler accessories and, more particularly, to a removable cooler assembly for preventing the soaking of foodstuff caused by melting ice.

2. Prior Art

Portable ice chests and coolers have been used for years by campers, fisherman, and the like for keeping food items and drinks cold. While these ice chests and coolers are proven to be able to maintain desired temperatures, the ice that is generally in the container tends to melt. Those food items that are in contact with the ice become soggy as the ice melts, thus reducing the desirability and freshness thereof. Aside from the obvious inconvenience of wet food and beverages stored in melted ice, keeping fish, shrimp, crabs, oysters, etc. in melted water in a cooler over time can subject the handler and consumers to bacterial contamination.

Many coolers are now provided with trays that allow for the food items to be placed therein for protection against the melting of the ice. These trays do not allow for ice to be utilized therein because the same problem will occur once the ice melts. Thus, it would be advantageous to have a means for keeping ice in the cooler, but separated from the food in such a way that the water from melted ice and food do not come in contact. Coolers with ice kept separately from food are well-known, but generally not with a cooling compartment separate from the food compartments.

Accordingly, a need remains for a removable cooler assembly in order to overcome the above-noted shortcomings. The present invention satisfies such a need by providing a removable cooler assembly that is easy to use and install, durable in nature, effective, and practical in design. The grid-like assembly allows food to be stored thereon while ice is placed on top of the food since water accumulates below the grid-like accessories.

Such an assembly conveniently provides a means for storing ice in the cooler separated from the food, while lowering the internal temperature of the cooler. The grid-like bottom portion of the assembly allows melted ice to drain away from the remaining ice and food. The lightweight design allows for easy removal and cleaning of the apparatus accessories. Such a removable assembly is especially useful to campers, picnickers, tailgaters, and other outdoor enthusiasts.

BRIEF SUMMARY OF THE INVENTION

In view of the foregoing background, it is therefore an object of the present invention to provide a removable cooler assembly. These and other objects, features, and advantages of the invention are provided by a removable assembly to prevent the soaking of foodstuff from melted ice.

In a preferred embodiment, the removable assembly includes a plurality of platforms having substantially planar upper surfaces spaced upwardly from the bottom surface of the cooler for effectively supporting the foodstuff thereabove. Each of the platforms are provided with a plurality of baffled slots formed therein such that the melted ice can conveniently drain downwardly therethrough and be maintained intermediate of the bottom surface and the platform upper surfaces respectively. Such platform slots preferably extend substantially orthogonal to the longitudinal axis.

The platforms preferably include a plurality of partitions extending downwardly from the upper surfaces and terminating above the bottom surface of the cooler such that lateral movement of the melted ice can advantageously be restricted during transportation between remote locations. A plurality of outer walls extend along a perimeter of the platforms. Such outer walls are provided with a plurality of openings spaced therealong defining a plurality of channels through which the melted ice can conveniently flow so that selected amounts of the melted ice do not become trapped along outer perimeters of the platforms respectively.

Each of the platforms may further include a substantially linear tongue portion and a substantially linear groove portion oppositely spaced therefrom such that adjacent ones of the tongue and groove portions become detachably locked and juxtaposed end-to-end when the platforms are positioned into the cavity.

In an alternate embodiment, a plurality of spaced racks are slidably positionable within a cooler body such that the racks become spaced apart adjacent to opposed ends of a cooler body. Such racks are offset at an oblique angle from a vertical axis traversing the cooler such that the melted ice can advantageously be directed downwardly and away from the top surfaces of the platforms so that foodstuff supported on the platforms can remain isolated from the melted ice. The plurality of racks preferably include substantially planar back surfaces extending along a longitudinal length of the racks and opposed sidewalls integrally connected to the back surfaces and displaced substantially orthogonal thereto.

A plurality of finger-like protrusions having first and second surfaces are connected to the back surfaces and travel outwardly therefrom respectively such that a user may effectively isolate a plurality of ice cubes from the foodstuff by positioning the ice cubes along the protrusions. Such second surfaces are angled downwardly from a horizontal plane such that the melted ice can conveniently be directed along a lateral path traveling towards a cooler body walls.

In a further embodiment, the assembly includes a cooler body having a planar bottom portion and a plurality of sidewalls extending vertically therefrom and defining a cavity therein. The cooler body further includes a removable top portion. A plurality of spaced racks are slidably positionable within the cooler body such that the racks become spaced apart adjacent opposed ends of the cooler body. Such racks are offset at an oblique angle from a vertical axis traversing the cooler body so that the melted ice can be directed downwardly and away from the top surfaces of the platforms so that foodstuff supported on the platforms can remain isolated from the melted ice. In such a further embodiment, the cooler body is provided in combination with the platforms and racks.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
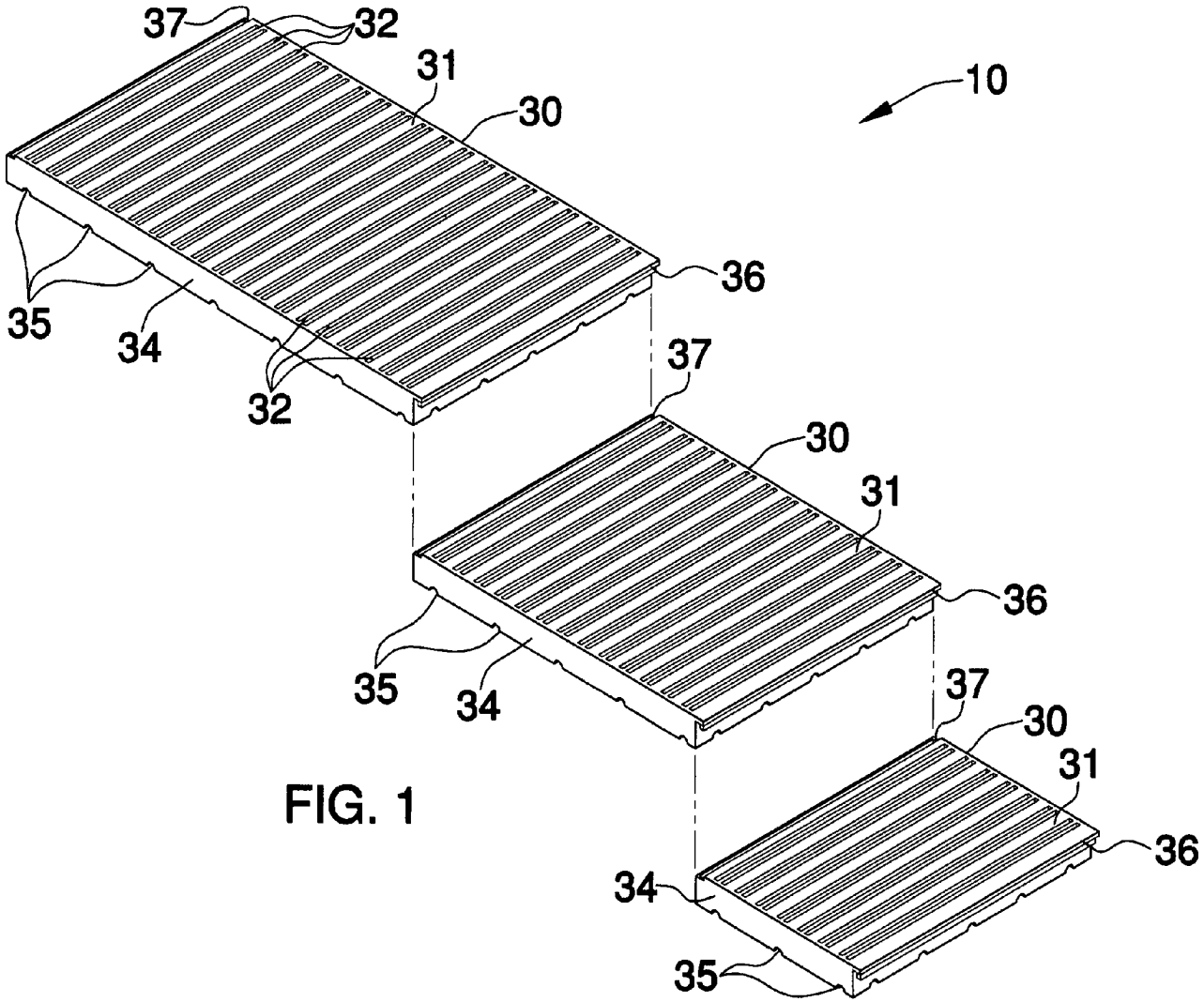
FIG. 1 is a perspective view showing the plurality of platforms, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The assembly of this invention is referred to generally in FIGS. 1-6 by the reference numeral 10 and is intended to provide a removable cooler assembly. It should be understood that the assembly 10 may be used to protect many different types of items from melted ice and should not be limited to only food items housed within a cooler.

Figure 2:
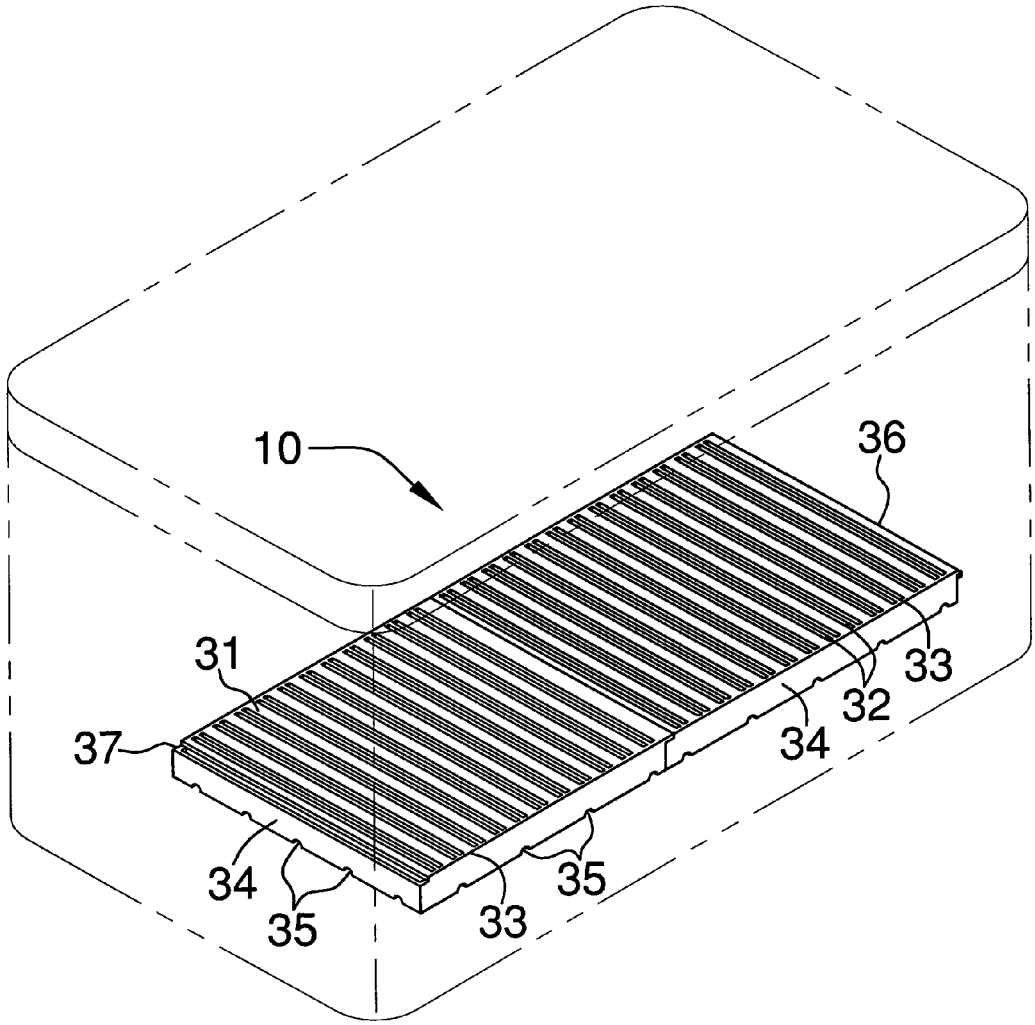
FIG. 2 is a transparent perspective view showing the portable assembly during operating conditions.

Referring initially to FIGS. 1 and 2, in a preferred embodiment, the assembly 10 includes a plurality of platforms 30 having substantially planar upper surfaces 31 spaced upwardly from the bottom surface of a cooler body for effectively supporting the foodstuff thereabove. Each of the platforms 30 are provided with a plurality of baffled slots 32 formed therein such that the melted ice can conveniently drain downwardly therethrough and be maintained intermediate of a bottom surface and the platform upper surfaces 31 respectively, thus advantageously isolating the foodstuff from the melted ice.

Such platform slots 32 extend substantially orthogonal to the longitudinal axis. In such an embodiment, the platforms 30 are provided independent of a cooler body and thus, may be used in a variety of storage devices and containers to keep melted ice from soaking foodstuff or other items, as is obvious to one having ordinary skill in the art.

Still referring to FIGS. 1 and 2, the platforms 30 include a plurality of partitions 33 extending downwardly from the upper surfaces 31 and terminating above a bottom surface of a cooler body such that lateral movement of the melted ice can advantageously be restricted during transportation between remote locations. A plurality of outer walls 34 extend along a perimeter of the platforms 30. Such outer walls 34 are provided with a plurality of openings 35 spaced therealong defining a plurality of channels through which the melted ice can conveniently flow so that selected amounts of the melted ice do not become trapped along outer perimeters of the platforms 30 respectively.

Referring to FIGS. 1 and 2, each of the platforms 30 further include a substantially linear tongue portion 36 and a substantially linear groove portion 37 oppositely spaced therefrom such that adjacent ones of the tongue 36 and groove 37 portions become detachably locked and juxtaposed end-to-end when the platforms 30 are positioned into the cavity. This conveniently ensures that that platforms 30 remain attached to each other, advantageously preventing the foodstuff from falling in between the platforms 30 and into the melted ice.

Figure 3:
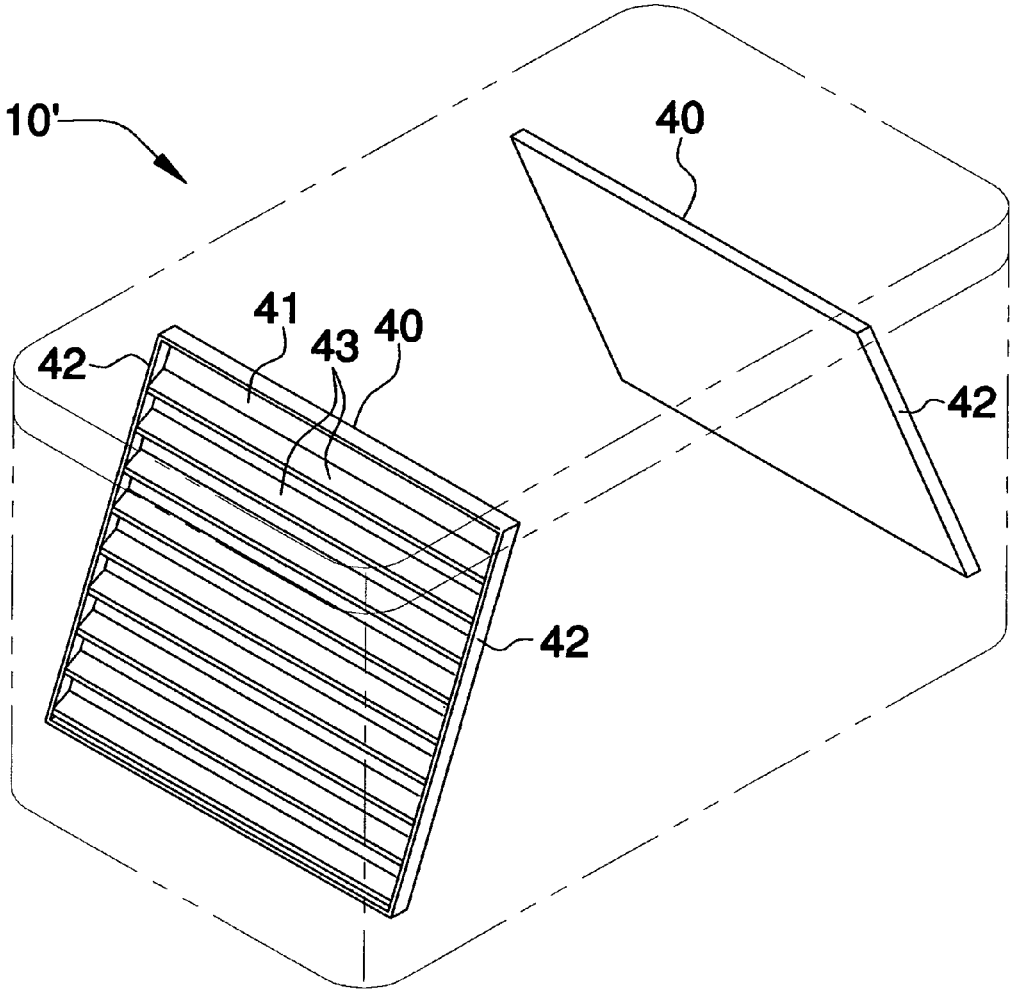
FIG. 3 is a transparent perspective showing the plurality of racks slidably positioned within a cooler body.
Figure 4:
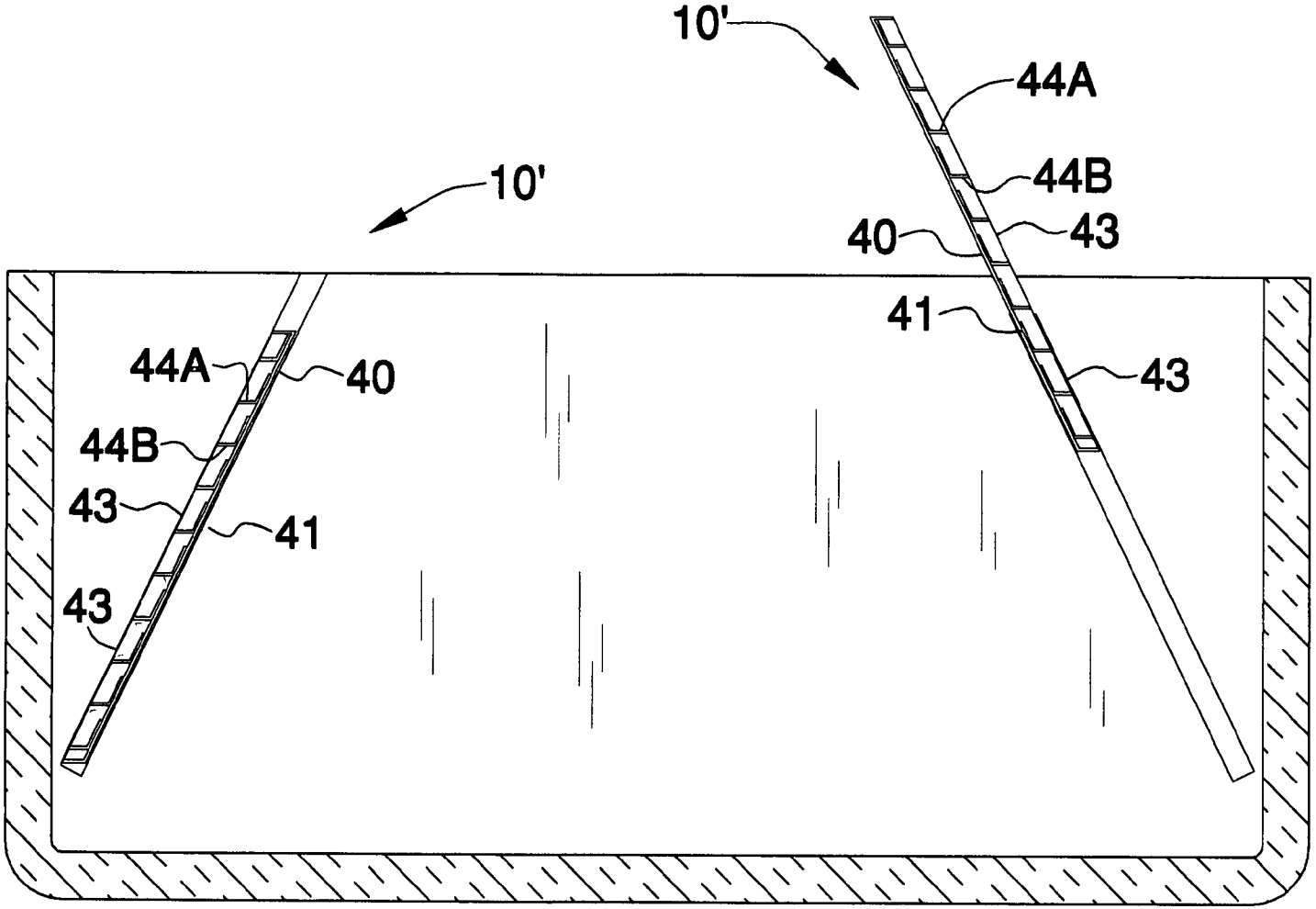
FIG. 4 is a cross-sectional view of the assembly shown in FIG. 3.

In an alternate embodiment 10', referring to FIGS. 3 and 4, a plurality of spaced racks 40 are slidably positionable within a cooler body such that the racks 40 become spaced apart adjacent to opposed ends of a cooler body. Such racks 40 are offset at an oblique angle from a vertical axis traversing a cooler body such that the melted ice can advantageously be directed downwardly and away from the top surfaces 31 of the platforms 30 so that foodstuff supported on the platforms 30 can remain isolated from the melted ice. The plurality of racks 40 include substantially planar back surfaces 41 extending along a longitudinal length of the racks 40 and opposed sidewalls 42 integrally connected to the back surfaces 41 and displaced substantially orthogonal thereto.

In such an alternate embodiment 10', the spaced racks 40 are provided in combination with the platforms 30'. Of course, such racks 40 and platforms 30' may be used in a variety of storage devices and containers to keep melted ice from soaking foodstuff and other items, as is obvious to one having ordinary skill in the art.

Referring to FIGS. 3 and 4, a plurality of finger-like protrusions 43 having first 44A and second 44B surfaces are connected to the back surfaces 41 and travel outwardly therefrom respectively such that a user may effectively isolate a plurality of ice cubes from the foodstuff by positioning the ice cubes along the protrusions 43. Such second surfaces 44B are angled downwardly from a horizontal plane such that the melted ice can conveniently be directed along a lateral path traveling towards the cooler body walls and away from the foodstuff.

Figure 5:
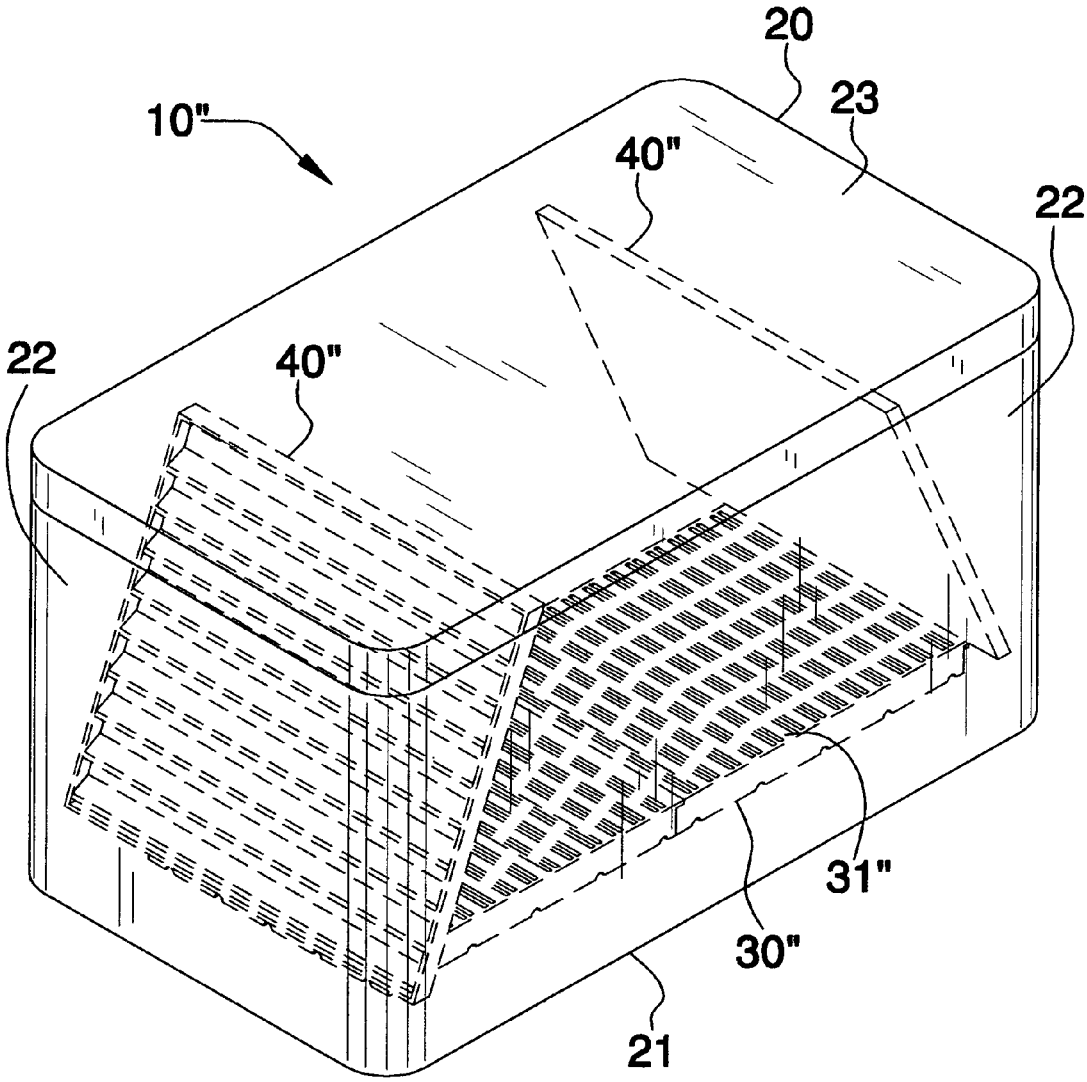
FIG. 5 is a transparent perspective view showing the cooler assembly including the plurality of platforms and racks positioned therein.
Figure 6:
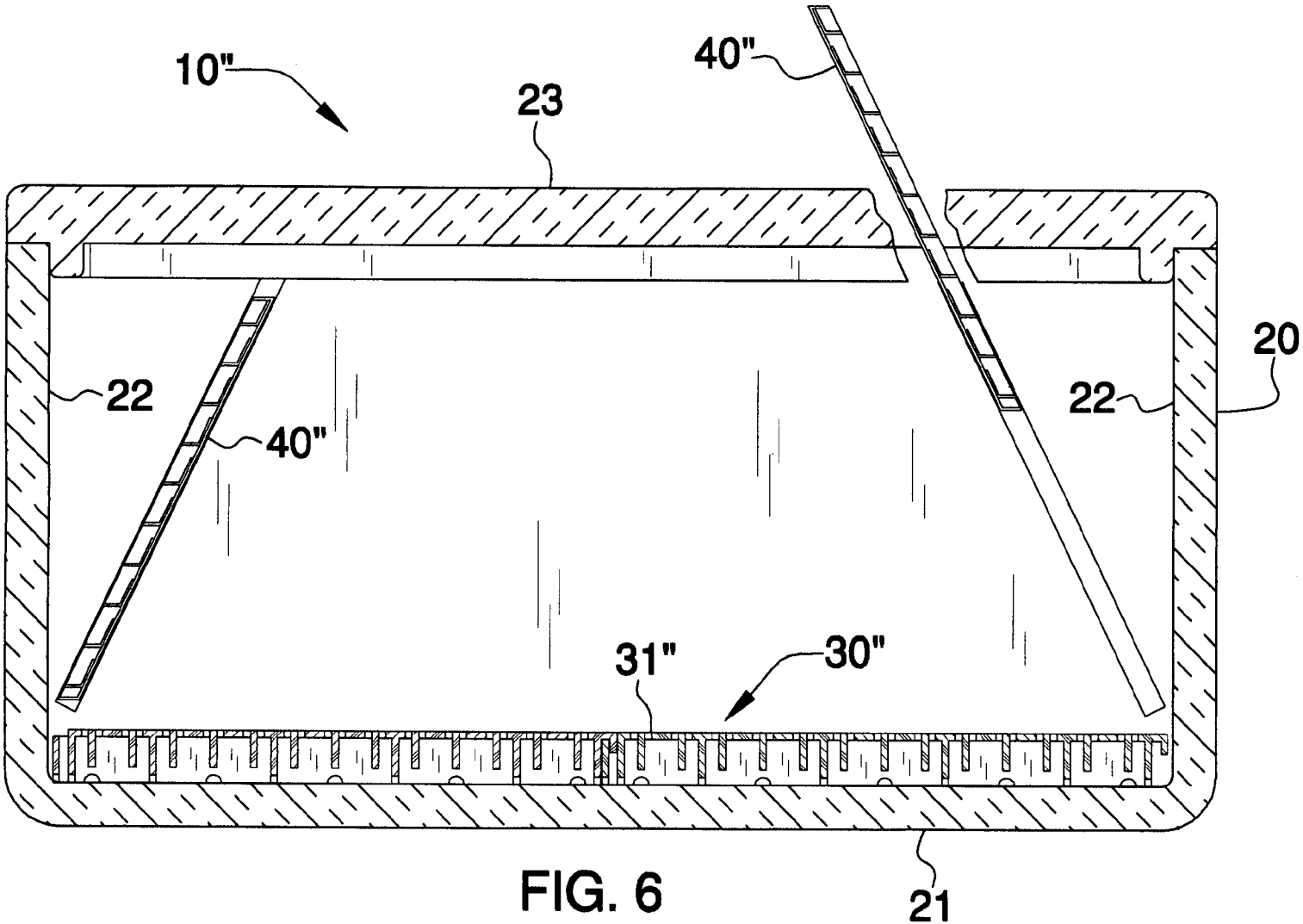
FIG. 6 is a cross-sectional view of the cooler assembly shown in FIG. 5, illustrating the slidable positioning of the plurality of racks.

Referring to FIGS. 5 and 6, in a further embodiment, the assembly 10" includes a cooler body 20 having a planar bottom portion 21 and a plurality of sidewalls 22 extending vertically therefrom and defining a cavity therein. The cooler body 20 further includes a removable top portion 23. A plurality of spaced racks 40" are slidably positionable within the cooler body 20 such that the racks 40" become spaced apart adjacent opposed ends of the cooler body 20. Such racks 40" are offset at an oblique angle from a vertical axis traversing the cooler body 20 so that the melted ice can be directed downwardly and away from the top surfaces 31" of the platforms 30" so that foodstuff supported on the platforms 30" can remain isolated from the melted ice. In such a further embodiment 10", the cooler body 20 is provided in combination with the platforms 30" and racks 40".

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable accessory for isolating foodstuff from melted ice housed within a common area, said portable accessory comprising:

a plurality of platforms including substantially planar upper surfaces spaced upwardly from a bottom surface of a cooler body and for supporting the foodstuff thereabove, each said platforms being provided with a plurality of baffled slots formed therein such that the melted ice can drain downwardly therethrough and be maintained intermediate of the bottom surface of the cooler body and said platform upper surfaces respectively, each said platforms comprising a plurality of partitions extending downwardly from said upper surfaces and terminating above the bottom surface of the cooler body such that lateral movement of the melted ice can be restricted during transportation between remote locations, and a plurality of outer walls extending along a perimeter of said platforms, said outer walls being provided with a plurality of openings spaced therealong for defining a plurality of channels through which the melted ice can flow so that selected amounts of the melted ice do not become trapped along outer perimeters of said platforms respectively.

2. The portable accessory of claim 1, wherein each said platforms comprise:

a substantially linear tongue portion; and a substantially linear groove portion oppositely spaced therefrom such that adjacent ones of said tongue and groove portions become detachably locked and juxtaposed end-to-end when said platforms are positioned into the cavity.

3. The portable accessory of claim 1, wherein said platform slots extend substantially orthogonal to the longitudinal axis.

4. A removable assembly for isolating foodstuff from melted ice housed within a common area, said removable assembly comprising:

a plurality of platforms including substantially planar upper surfaces spaced upwardly from a bottom surface of a cooler body and for supporting the foodstuff thereabove, each said platforms being provided with a plurality of baffled slots formed therein such that the melted ice can drain downwardly therethrough and be maintained intermediate of the bottom surface of the cooler body and said platform upper surfaces respectively, each said platforms comprising a plurality of partitions extending downwardly from said upper surfaces and terminating above the bottom surface of the cooler body such that lateral movement of the melted ice can be restricted during transportation between remote locations, and a plurality of outer walls extending along a perimeter of said platforms, said outer walls being provided with a plurality of openings spaced therealong for defining a plurality of channels through which the melted ice can flow so that selected amounts of the melted ice do not become trapped along outer perimeters of said platforms respectively; and a plurality of spaced racks slidably positionable within the cooler body such that said racks become spaced apart adjacent opposed ends of the cooler body, said racks being offset at an oblique angle from a vertical axis traversing the cooler body such that said melted ice can be directed downwardly and away from said top surfaces of said platforms so that foodstuff supported on said platforms can remain isolated from the melted ice.

5. The removable assembly of claim 4, wherein said platforms comprise:

a plurality of partitions extending downwardly from said upper surfaces and terminating above said bottom surface of said cooler body such that lateral movement of the melted ice can be restricted during transportation between remote locations; and a plurality of outer walls extending along a perimeter of said platforms, said outer walls being provided with a plurality of openings spaced therealong for defining a plurality of channels through which the melted ice can flow so that selected amounts of the melted ice do not become trapped along outer perimeters of said platforms respectively.

6. The removable assembly of claim 4, wherein each said platform comprises:

a substantially linear tongue portion; and a substantially linear groove portion oppositely spaced therefrom such that adjacent ones of said tongue and groove portions become detachably locked and juxtaposed end-to-end when said platforms are positioned into the cavity.

7. The removable assembly of claim 4, wherein said platform slots extend substantially orthogonal to a longitudinal axis.

8. The removable assembly of claim 4 wherein said plurality of racks comprise:

substantially planar back surfaces extending along a longitudinal length of said racks;

opposed sidewalls integrally connected to said back surfaces and displaced substantially orthogonal thereto; and a plurality of finger-like protrusions having first and second surfaces connected to said back surfaces and traveling outwardly therefrom respectively such that a user may effectively isolate a plurality of ice cubes from the foodstuff by positioning the ice cubes along said protrusions.

9. The removable assembly of claim 8, wherein said second surfaces are angled downwardly from a horizontal plane such that the melted ice can be directed along a lateral path traveling towards the walls of the cooler body.

10. A cooler assembly for isolating foodstuff from melted ice housed within a common area, said removable assembly comprising:

a cooler body having a planar bottom portion and a plurality of sidewalls extending vertically therefrom, said cooler body further including a removable top portion, said cooler body further having a plurality of linear channels formed in said sidewalls respectively;

a plurality of platforms including substantially planar upper surfaces spaced upwardly from a bottom surface of the cooler body and for supporting the foodstuff thereabove, each said platforms being provided with a plurality of baffled slots formed therein such that the melted ice can drain downwardly therethrough and be maintained intermediate of the bottom surface of the cooler body and said platform upper surfaces respectively, each of said baffled slots being formed along a top surface of said platforms and oriented along a horizontal plane that is registered parallel to said planar bottom portion of said cooler, each said platforms comprising a plurality of partitions extending downwardly from said upper surfaces and terminating above the bottom surface of the cooler body such that lateral movement of the melted ice can be restricted during transportation between remote locations, and a plurality of outer walls extending along a perimeter of said platforms, said outer walls being provided with a plurality of openings spaced therealong for defining a plurality of channels through which the melted ice can flow so that selected amounts of the melted ice do not become trapped along outer perimeters of said platforms respectively; and a plurality of spaced racks slidably positionable within the cooler body such that said racks become spaced apart adjacent opposed ends of the cooler body, said racks being offset at an oblique angle from a central vertical axis traversing the cooler body such that said melted ice can be directed downwardly and away from said top surfaces of said platforms so that foodstuff supported on said platforms can remain isolated from the melted ice, said racks are sloped downwardly and away from said lid and being equidistantly offset from the central vertical axis, said racks being slidably and linearly interfitted along said channels.

11. The cooler assembly of claim 10, wherein said platforms comprise:

a plurality of partitions extending downwardly from said upper surfaces and terminating above the bottom surface of the cooler body such that lateral movement of the melted ice can be restricted during transportation between remote locations; and a plurality of outer walls extending along a perimeter of said platforms, said outer walls being provided with a plurality of openings spaced therealong for defining a plurality of channels through which the melted ice can flow so that selected amounts of the melted ice do not become trapped along outer perimeters of said platforms respectively.

12. The cooler assembly of claim 10, wherein each said platform comprises:

a substantially linear tongue portion; and a substantially linear groove portion oppositely spaced therefrom such that adjacent ones of said tongue and groove portions become detachably locked and juxtaposed end-to-end when said platforms are positioned into the cavity.

13. The cooler assembly of claim 10, wherein said platform slots extend substantially orthogonal to a longitudinal axis.

14. The cooler assembly of claim 10, wherein said plurality of racks comprise:

substantially planar back surfaces extending along a longitudinal length of said racks;

opposed sidewalls integrally connected to said back surfaces and displaced substantially orthogonal thereto; and a plurality of finger-like protrusions having first and second surfaces connected to said back surfaces and traveling outwardly therefrom respectively such that a user may effectively isolate a plurality of ice cubes from the foodstuff by positioning the ice cubes along said protrusions.

15. The cooler assembly of claim 14, wherein said second surfaces are angled downwardly from a horizontal plane such that the melted ice can be directed along a lateral path traveling towards the walls of the cooler body.

* * * * *